United States Patent [19]

Schmatz

[11] Patent Number: 4,577,610

[45] Date of Patent: Mar. 25, 1986

[54] IGNITION DISTRIBUTOR SYSTEM FOR AN INTERNAL COMBUSTION ENGINE

[75] Inventor: Jürgen Schmatz, Mundelsheim, Fed. Rep. of Germany

[73] Assignee: Robert Bosch GmbH, Stuttgart, Fed. Rep. of Germany

[21] Appl. No.: 648,666

[22] Filed: Sep. 10, 1984

[30] Foreign Application Priority Data

Dec. 29, 1983 [DE] Fed. Rep. of Germany ..... 3347409

[51] Int. Cl.[4] ..... H01H 19/00

[52] U.S. Cl. ..... 123/633; 123/146.5 A; 200/19 R

[58] Field of Search ..... 123/633, 146.5 A, 146.5 R, 123/594; 200/19 DC, 19 R, 19 DR, 306, 19 A, 21, 24

[56] References Cited

U.S. PATENT DOCUMENTS

| | | | |
|---|---|---|---|
| 2,555,488 | 6/1951 | Hetzlet et al. | 123/633 |
| 2,688,714 | 9/1954 | Buchmann | 123/633 |
| 4,186,712 | 2/1980 | Fitzner et al. | 123/633 |
| 4,332,988 | 6/1982 | Dungan et al. | 123/633 |
| 4,349,709 | 9/1982 | Micheli et al. | 123/633 |
| 4,369,343 | 1/1983 | Sone et al. | 123/633 |
| 4,468,543 | 8/1984 | Sone et al. | 123/633 |

FOREIGN PATENT DOCUMENTS

| | | | |
|---|---|---|---|
| 3136745 | 3/1983 | Fed. Rep. of Germany | 123/633 |

*Primary Examiner*—Raymond A. Nelli

*Attorney, Agent, or Firm*—Frishauf, Holtz, Goodman & Woodward

[57] ABSTRACT

To improve the noise suppression characteristics of an ignition system for an Otto-type internal combustion engine, radio noise suppression resistors (8, 18, 22) are molded into the distributor cap (25) and electrically connected, respectively, between the tower cable connectors (19, 21, 23) on the distributor cap and the respective distributor cap terminals, which may be the peripheral terminals (16, 17) or the center wiping or sliding terminal (9) for the distributor rotor. The distributor rotor then can have a single highly conductive electrical element as a center electrode, leading to the outside peripheral rotating distributor electrode (14), which is spaced from the fixed gap electrodes by a spacing of between 0.5 to 3 mm, preferably at least 2 mm. Preferred values for the noise suppression resistors are between 1 to 5 kilo ohms.

16 Claims, 1 Drawing Figure

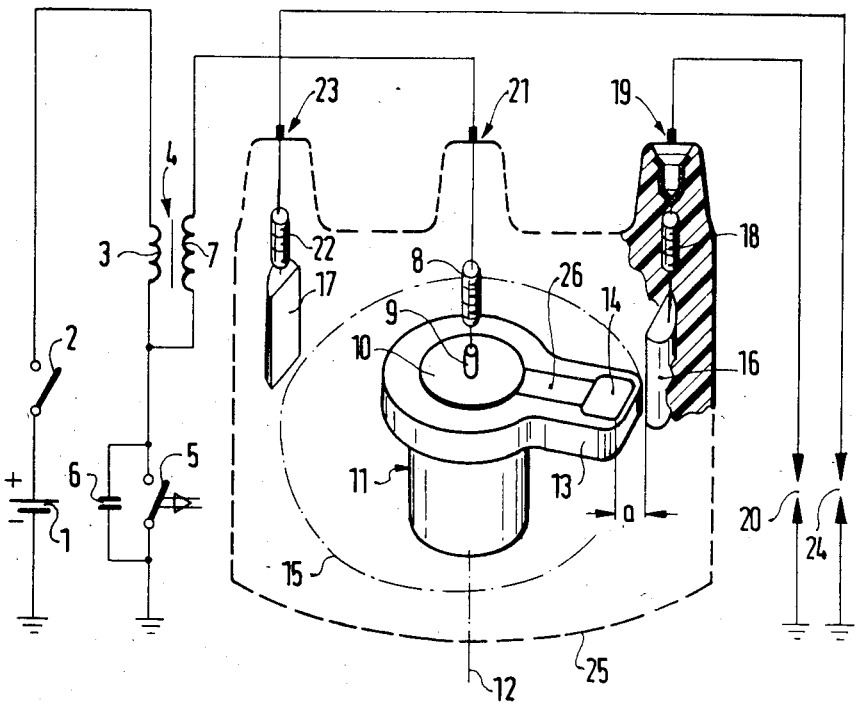
23
21
19
4
3
7
22
8
26
14
18
17
9
10
16
2
5
6
11
13
a
20
24
1
15
12
25

IGNITION DISTRIBUTOR SYSTEM FOR AN INTERNAL COMBUSTION ENGINE

The present invention relates to a distributor system to distribute ignition energy to the spark plugs of a multi-cylinder internal combustion engine, and more particularly to an ignition distributor system which includes radio noise suppression features.

BACKGROUND

It is frequently desirable to suppress radio noise interference emanating from the ignition system of an internal combustion engine. One such arrangement is described in the referenced publication, German Patent Disclosure Document No. DE-OS 31 36 745 corresponding to U.S. Pat. No. 4,475,491, issued Oct. 9, 1984, in which a reduction in radio noise interference, radiated from the ignition system, and particularly the distributor system, is obtained. Further decrease in interfering or noise radiation is still desirable, particularly to reduce interference with radio receivers, television receivers, or other radio equipment which is positioned in the vicinity of the ignition system for an internal combustion engine, for example installed in a motor vehicle. In accordance with the disclosure, a central contact terminal plate on the rotor of the distributor is connected to a peripheral distributor electrode over a noise suppression or interference suppression resistor. It is comparatively difficult to make such a connection easily, inexpensively and reliably, and to place a noise suppression resistor on or in the rotor of the distributor.

THE INVENTION

It is an object to improve the interference radiation from the distributor system of an internal combustion engine without increasing to a marked extent the complexity of manufacture of a distributor or components thereof, so that the desired end of low radio noise interference can be achieved without any significant increase in cost of the distributor or components or accessories thereof.

Briefly, the terminal connections of the distributor cap are so arranged that noise suppression resistors are serially connected between the spark plug cable connectors and the rotor gap terminals. In addition, or alternatively—as desired—the central terminal plate of the rotor, usually connected to the center connection which leads to the ignition coil, also has a noise suppression resistor serially connected therein. In addition, and in order to provide good matching, with minimum radiated noise of the operation of the distributor with respect to a spark plug and an ignition coil, the rotating or rotor distributor electrode is spaced from the fixed gap electrodes by a spacing of from about 0.5 to 3 mm, preferably at least about 2 mm. The values of the resistors serially connected between the center electrode and/or the gap electrodes may be in the range of from 0.5 to 10 kilo ohms, preferably between 1 and 5 kilo ohms.

The arrangement has the advantage that noise radiation of the ignition system is further reduced over and beyond that previously obtainable, while resulting in a very simple and easy manufacture of the components of the system.

DRAWING

The single FIGURE is a part-schematic, part-sectional, part-pictorial representation of an ignition system for a multi-cylinder internal combustion engine.

DETAILED DESCRIPTION

The ignition system shown in the FIGURE is intended to be used with a multi-cylinder internal combustion engine, for example a two-cylinder engine. Of course, by multiplying the fixed or gap electrodes, the same invention can be used with three, four, five, six, eight and more cylinder engines. Typically, the system is used in an automotive multi-cylinder internal combustion engine.

A source of direct current, typically an automobile battery 1, has one terminal connected to ground or vehicle chassis, and the other, usually the positive terminal, to an operating switch 2 which then is connected through the primary winding 3 of an ignition coil 4 and to the terminals of a breaker switch 5. The breaker switch 5 may, of course, be a solid-state switch, such as a transistor of a transistorized ignition system. The terminal of the primary winding 3, which is remote from the battery 1 and the serially connected main switch 2, is additionally connected to one terminal of the secondary 7. Further, a noise suppression capacitor 6 is connected across the interrupter or switch contacts 5. The noise suppression capacitor 6 is particularly desirable if the switch 5 is a mechanical switch.

The secondary winding 7 of the ignition coil 4 is connected to a wiping terminal 9 which is the usual terminal positioned in the center high-voltage tower of an ignition distributor cap, and which may be a carbon or graphite contact pressing against a spring contact plate 10 located on the rotor 11 of the distributor. The contact terminal 10 is secured to the upper face of a cylindrical insulating body 11 which is connected to the distributor shaft 12, shown only schematically. The distributor shaft 12 rotates with the engine, usually with interposition of a centrifugal ignition timing controller. The distributor rotor 13 has a laterally projecting finger, the far end of which has a rotor electrode 14 fitted therein. Upon rotation of the insulating body 11, and hence the rotor 13, the free facing end of the distributor electrode 14 is rotated on a circular path 15. As the rotor moves, and predetermined angular portions are passed, the terminal 14 passes in advance of fixed or gap electrodes 16, 17, fixedly located within the distributor cap. The spacing a between the end or edge face of the distributor electrode 14 and the respective gap electrodes 16, 17 is between about 0.5 to 3 mm. In a preferred form, the spacing is about at least 2 mm.

In accordance with a feature of the invention, a noise suppression resistor 8 is electrically connected between the secondary winding 7 of the ignition coil and the wiping contact 9. In accordance with a further feature of the invention, a noise suppression resistor 18 is electrically serially connected between the gap electrode 16 and a distributor tower terminal 19 from which an ignition cable leads to a spark plug 20. The tower connector 19 is severable, to permit replacement of the spark plug cable which, as well known, deteriorates with age, under the influence of oil, vapor and the like. A similar plug connection 21 is provided for the coil ignition cable between the secondary winding 7 and the wiping contact 9 or, rather, the resistor 8 which is serially connected with the wiping contact 9. A second gap electrode 17 is connected through a resistor 22 to a power connector 23 for connection to an ignition cable leading to a spark plug 24, similar to the arrangement described in connection with gap electrode 16, resistor 18, terminal 19 and spark plug 20. The other terminal of the spark plug, as is well known, is connected to ground or chassis.

The noise suppression feature with respect to the electrodes in the distributor cap is shown in detail only with respect to the gap electrode 16; a similar arrangement can be provided for the center electrode 8 and, of course, for the other gap electrode 17.

The fixed electrode 16, 17 and, if desired, the center wiping contact 9, each, are connected serially with respective noise suppression resistors 18, 22, 8 which, in turn, are connected to the plug-in terminals 19, 23, 21, all embedded in or molded into the distributor cap to form a single structural entity or unit. The structure of the cap, other than the incorporation of the suppression resistors 18, 22 and/or 8, can be of standard shape and construction, and, therefore, is shown only in broken lines 25 in the drawing.

The distributor electrode 14 is made of an alloy containing silicon and calcium, including about 33% silicon and about 65% calcium—by weight—and a remainder of, for example, salts which contain sodium. The contact plate 10 is made of highly conductive material, such as copper, brass, bronze, or even iron.

The contact plate 10 and the distributor electrode 14 are electrically connected by a conductive portion 26. The conductive portion 26 may be an extension of the center terminal 10, and may be made of the same material. The gap spacing a of the distributor electrode 14 from the fixed gap electrodes 16, 17 is between about 0.5 to 3 mm, preferably of at least about 2 mm, so that, upon a high voltage being applied to the electrode 14, a spark can jump over to the fixed electrode to transfer electrical energy to the respective spark plug, without requiring a wiping or mechanical contact.

The resistors 8, 18, 22 should have a value of between 500 and 10,000 ohms; in a preferred form, the value of the resistors is between about 1000 and 5000 ohms.

Operation: Let it be assumed that the operating switch 2 is closed. Current will flow from the battery 1 to the primary of the ignition coil 3 if, at the same time, the switch 5 is closed, to establish an entirely conductive path. If, then, the switch 5 is suddenly opened, for example by controlling a transistor to blocking state, the current flowing through the primary winding 3 is suddenly interrupted, and a high-voltage pulse will be induced in the secondary winding 7 which is transferred by the circuit: 21-8-9-10-26-14 to a respective electrode 16, 17, by causing a spark to jump over between the electrode 14 and the fixed electrode 16 or 17, respectively. The current flowing in that spark discharge will cause a spark to jump over at the spark gaps 20, 24, respectively, to provide for an ignition spark at the spark plug.

The system provides for effective suppression of stray, interfering or noise-generated high-frequency radiation. The distributor rotor 13, with the cylindrical portion 11, the terminal plate 10, the distributor electrode 14 and the conductive portion 26 can be easily made as an injection-molded plastic element, with the metal parts embedded adjacent the circumference thereof, since it is not necessary to include a noise suppression resistor in the distributor rotor. By suitable choice of the material for the electrode 14 and of the distance a, which defines the distributor gap, that is, the gap between the distributor 14 and the gap electrodes 16, 17, respectively, as the distributor electrode 14 moves past the gap electrodes, also limits the ignition and subsequent breakdown voltage to a level at which the resulting heating of the elements 14 and 16, 17, respectively, is within easily acceptable and tolerable limits.

The contact plate 10, the conductive portion 26, which may be a conductive strip, and the distributor electrode 14 can be made as a single unitary constructional element which, prior to manufacture, is placed in a mold, to be subsequently embedded in the distributor rotor 13, with the cylindrical portion 11 attached thereto, to form a single molded or cast-in structural element.

I claim:

1. A simplified, radio-noise-suppressing ignition distributor, for a multi-cylinder Otto-type internal combustion engine, comprising a housing (25);

a rotor (13) of insulating material;

a unitary constructional element embedded in the rotor (13) and having portions, of the same material, defining a center terminal (10), a peripheral distributor terminal (14), and an electrically-high-conductivity connection (26) between the center terminal (10) and the peripheral distributor terminal (14);

a center connecting terminal (9) of carbon secured to the housing (25) and positioned for sliding contact under spring pressure with the center terminal (10) of the rotor (13);

a center ignition coil cable connector (21) secured to the housing (25);

peripheral spark plug cable terminal connectors (19, 23) secured substantially within the housing;

gap terminals (16, 17) peripherally positioned within the housing, and located so that the peripheral distributor terminal (14) of the rotor (13), upon rotation thereof, sweeps past said gap terminals (16, 17);

a noise suppression resistor (8) connected between said center connecting terminal (9) and said ignition coil cable connector (21);

and at least one radio noise suppression resistor (18, 22) electrically connected between each of the peripheral cable connectors (19, 23) and the associated terminal (16, 17);

and wherein the peripheral terminal (14) of the rotor is positioned on said rotor (13) with a spacing (a) of between 0.5 and 3 mm from each gap terminal (16, 17) when rotationally aligned respectively therewith.

2. Distributor according to claim 1, wherein each of the spark plug cable terminal connectors (19, 23) and each of the associated gap terminal (16, 17) are connected by a respective radio noise suppression resistor (18, 22).

3. Distributor according to claim 2, wherein a center connecting terminal (9) is provided, secured to the housing and positioned for wiping or sliding connection with center terminal (10) of the rotor;

and wherein said radio noise suppression resistor (8) is connected between the center connecting terminal (9) and said ignition coil cable connector (21).

4. Distributor according to claim 2, wherein the spacing (a) between the peripheral terminal (14) of the rotor (13) and a gap terminal (16, 17) is at least about 2 mm.

5. Distributor according to claim 2, wherein the housing (25) comprises a distributor cap of molded insulating material;

and the radio noise suppression resistor (8, 18, 22) is molded into said insulating cap.

6. Distributor according to claim 1, wherein the value of said radio noise suppression resistor is between about 0.5 and 10 kilo ohms.

7. Distributor according to claim 1, wherein the value of said radio noise suppression resistor is between about 1 and 5 kilo ohms.

8. Distributor according to claim 1, wherein the spacing (a) between the peripheral terminal (14) of the rotor (13) and a gap terminal (16, 17) is at least about 2 mm.

9. Distributor according to claim 1, wherein the housing (25) comprises a distributor cap of molded insulating material;

and the radio noise suppression resistor (8, 18, 22) is molded into said insulating cap.

10. Distributor according to claim 1, wherein the material of said unitary constructional element is an alloy.

11. Distributor according to claim 8, wherein the housing (25) comprises a distributor cap of molded insulating material;

and the radio noise suppression resistor (8, 18, 22) is molded into said insulating cap.

12. Distributor according to claim 10, wherein said alloy comprises about 65% calcium and about 33% silicon.

13. Distributor according to claim 3, wherein the value of at least one of the resistors connected to said cable connectors is between 0.5 and 10 kilo ohms.

14. Distributor according to claim 3, wherein the value of at least one of the resistors connected to said cable connectors is between 1 and 5 kilo ohms.

15. Distributor according to claim 3, wherein the housing (25) comprises a distributor cap of molded insulating material;

and the radio noise suppression resistor (8, 18, 22) is molded into said insulating cap.

16. Distributor according to claim 7, wherein the housing (25) comprises a distributor cap of molded insulating material;

and the radio noise suppression resistor (8, 18, 22) is molded into said insulating cap.

* * * * *